United States Patent [19]

Koseki et al.

[11] Patent Number: 4,986,079

[45] Date of Patent: Jan. 22, 1991

[54] APPARATUS AND METHOD OF GENERATING COLDNESS

[75] Inventors: Yasuo Koseki, Hitachiota; Akira Yamada, Hitachi; Hideaki Kurokawa, Hitachi; Isao Ohkouchi, Hitachi; Katsuya Ebara, Mito; Sankichi Takahashi, Hitachi, all of Japan

[73] Assignee: Hitachi, Ltd., Tokyo, Japan

[21] Appl. No.: 391,083

[22] Filed: Aug. 9, 1989

[30] Foreign Application Priority Data

Aug. 12, 1988 [JP] Japan ..... 63-199892

[51] Int. Cl.[5] ..... F25D 3/00

[52] U.S. Cl. ..... 62/59; 62/476

[58] Field of Search ..... 62/59, 476

[56] References Cited

U.S. PATENT DOCUMENTS

| | | | |
|---|---|---|---|
| 4,090,372 | 5/1978 | Lamb | 62/476 X |
| 4,302,944 | 12/1981 | Gainer | 62/59 |
| 4,329,851 | 5/1982 | Bourne | 62/476 X |
| 4,596,120 | 6/1986 | Knodel et al. | 62/59 |

*Primary Examiner*—Lloyd L. King

*Attorney, Agent, or Firm*—Antonelli, Terry, Stout & Kraus

[57] ABSTRACT

A coldness generating apparatus comprising: an absorption type refrigerator having an evaporator for evaporating refrigerant, an absorber in which an absorbent for absorbing the thus-evaporated refrigerant steam is contained, a regenerator for heating and condensing the absorbent which has been diluted by the refrigerant steam, and a condenser for condensing and liquidizing the refrigerant steam which has been evaporated by heating and condensing the absorbent. A regenerating tank regenerates coldness generated by the evaporator, and the refrigerant comprises refrigerant having the solidification temperature lower than the freezing point so that coldness which is lower than the freezing point and which has been generated in the evaporator is regenerated in the form of ice or ice slurry. Since coldness can be regenerated at high density, cooling performance can be improved.

10 Claims, 3 Drawing Sheets

APPARATUS AND METHOD OF GENERATING COLDNESS

BACKGROUND OF THE INVENTION

1. FIELD OF THE INVENTION

The present invention relates to coldness generating method and apparatus including a regenerating tank and capable of being used as an air conditioning apparatus, and more particularly, to a coldness generating method apparatus for generating and regenerating a coldness lower than the freezing point.

2. DESCRIPTION OF RELATED ART

An absorption type refrigerator capable of being used as an air conditioning apparatus generally employs water as the refrigerant thereof. Therefore, it can supply coldness of unsatisfactory level of 5° to 7° C. As a result, a large sized regenerating tank is necessary to regenerate the thus-generated coldness in the form of cold water.

On the other hand, a refrigerator equipped with a compression type heat pump such as disclosed, for example, in Japanese Patent Unexamined No. 61-62774, can generate coldness of a level below the freezing point. Therefore, the thus-generated coldness can be regenerated in the form of ice. As a result, the capacity of the regenerating tank thereof can be reduced with respect to that of the above-described absorption type refrigerator.

It is difficult, in terms of practical use, for the compression type heat pump to employ energy other than electricity for driving the pump. Furthermore, electrical is energy of very costly and a heat pump of a large capacity encounters critical problems of noise and vibrations.

On the other hand, the absorption type refrigerator exhibits a reduced cost with respect to the required electrically operated structure since the absorption type refrigerator is capable of employing, as an energy source, heavy oil, LPG, waste heat, solar heat, or the like. However, the conventional absorption type refrigerator encounters a problem in that its constructional cost cannot be reduced.

SUMMARY OF THE INVENTION AND OBJECTS OF THE INVENTION

An object of the present invention is to provide a coldness generating apparatus and a method of generating coldness which employs an absorption type refrigerator to generate coldness below the freezing point capable of forming ice or ice slurry to be regenerated in a regenerating tank thereof which exhibits an excellent regenerating efficiency.

STATEMENT OF THE INVENTION

In order to achieve the above-described object, a coldness generating apparatus according to the present invention comprises an evaporator for evaporating refrigerant, with an absorber which contains an absorbent for absorbing the thus-evaporated refrigerant steam. A regenerator heats and condenses the absorbent which has been diluted by the refrigerant steam, with a condenser condensing and liquidizing the refrigerant steam which has been evaporated by heating and condensing the absorbent. A regenerating tank regenerates coldness generated by the evaporator, and the refrigerant includes refrigerant having a solidification temperature lower than a freezing point so that coldness which is lower than the freezing point and which has been generated in the evaporator is regenerated in the form of ice or ice slurry.

Furthermore, a coldness generating method according to the present invention comprises the steps of arranging an absorption type refrigerator such that refrigerant steam evaporated by an evaporator is absorbed by absorbent in the absorber, heating the absorbent diluted by the refrigerant steam, condensing the absorbent by a regenerator, and liquidizing the refrigerant steam evaporated due to condensation by a condenser so that coldness is generated. A refrigerant is used whose solidification temperature is lower than the freezing point for the absorption type refrigerator, and the coldness lower than the freezing point obtained by being evaporated by the evaporator is circulated to the regenerating tank. Heat is regenerated by forming ice or ice slurry in the regenerating tank, and the regenerated coldness is circulated to a radiator disposed outside a system so that the coldness is radiated.

It is preferable for the coldness generating method that its structure is arranged such that ice slurry is prepared in the regenerating tank and the thus-prepared slurry is directly circulated to the radiator disposed outside the system for the purpose of discharging heat.

It is preferable that ice slurry comprising W/O (Water/Oil) emulsion is prepared in the regenerating tank and the thus-prepared slurry directly circulated to the radiator disposed outside the system for the purpose of discharging heat.

It is preferable that refrigerant with the solidification temperature which is lower than the freezing point is used. Specifically, it is preferable that lower alcohol such as methanol, ethanol, propanol, and the like, or mixed solution of the above alcohol and water is employed.

Furthermore, mixed solution of inorganic electrolyte and water may be employed, the inorganic electrolyte being exemplified by bromide such as LiBr, $CaBr_2$, and the like, and chloride such as LiCl, $CaCl_2$, and the like.

It is preferable that the absorbent is prepared by: bromide such as LiBr, $CaBr_2$, KBr, and the like; chloride such as LiCl, CuCl, $CuCl_2$, $CaCl_2$, KCl, and the like; carbonate such as $K_2CO_3$, $Na_2CO_3$, and the like; nitrate such as $Li_2NO_3$; or their mixture.

It is further preferable that sodium salt is added for the purpose of improving solubility between the refrigerator above and the absorbent, this sodium salt being exemplified by NaCl, $Na_3PO_4$, $Na_2SO_4$, $Na_2S_2O_3$, and the like.

The refrigerant and the absorbent above may be selected in accordance with the way of usage. For example, coldness of the level substantially −10° C. can be generated by using methanol as refrigerant and using LiBr as absorbent. Since water is not frozen until the temperature becomes −10° C. by way of adding $CaCl_2$ by substantially 15%, ice can be readily made.

The coldness obtained with the evaporator of the absorption type refrigerator is introduced into the regenerating tank through brines such as ethylene glycol and is then circulated in this regenerating tank so that the regenerating agent or water is cooled down to the freezing point. As a result, the thus-cooled regenerating agent or water is converted into the form of ice or ice slurry so that heat is regenerated. Therefore, heat regenerating can be efficiently performed. Water/oil (W/0) type ice slurry can be readily prepared by employing W/0 type emulsion as the regenerating agent above. Since the thus-obtainable slurry is formed by small spherical ice droplets, it can be advantageously circulated to the radiator disposed outside the system.

In order to transmit the coldness in the regenerating tank to the radiator disposed outside the system, it is effective to directly transmit ice slurry of the above-described W/0 type since the diameter of the pipes or the like can be reduced. Ice can be advantageously employed as the coldness transmitting medium in terms of transmitting convenience. When water is employed as the medium of the type above, a great cooling performance can be obtained in the radiator since water can be transmitted with its temperature lowered to a level approximated to the freezing point. Furthermore, in a case in which a conventionally obtainable cooling performance is required, the diameter of the coldness transmission pipe can be reduced.

The absorption type refrigerator according to the present invention may employ electricity and as well employ combustion heat such as heavy oil and LPG, and low cost energy such as waste heat, solar heat, and geothermal as the energy source thereof. In addition, dump power generated during night can be utilized in the form of regenerated heat.

If necessary, it can be employed in the form of a combination with the compression type heat pump.

According to the absorption type refrigerator of the present invention, since coldness below the freezing point can be obtained by employing a refrigerant whose solidification point is lower than the freezing point, ice or ice slurry can be readily generated. Since the thus-obtainable ice or ice slurry displays great latent heat, a significantly great regenerated heat can be obtained with respect to that obtainable with water. Therefore, the size of the regenerating tank can be reduced.

DESCRIPTION OF THE PREFERRED EMBODIMENTS

Figure 1:
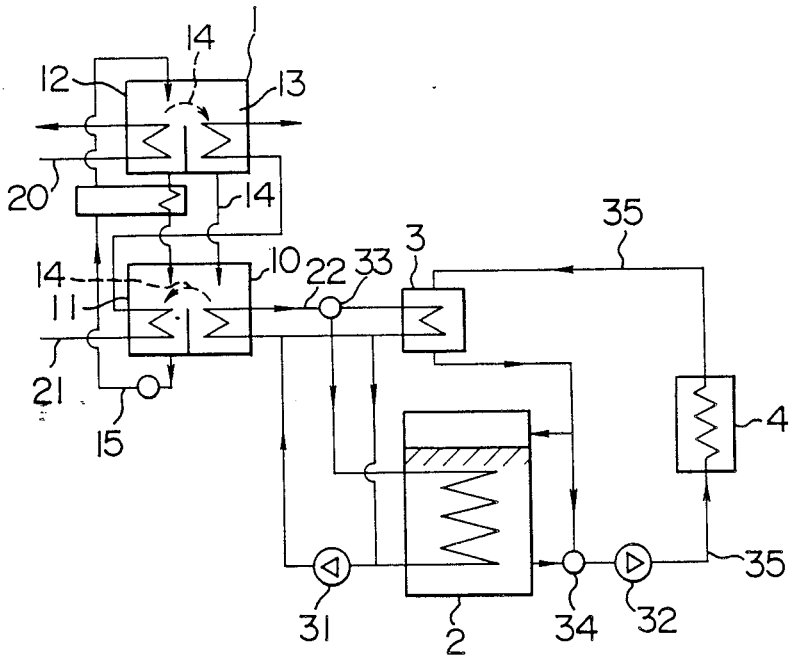
FIG. 1 is a schematic view which illustrates an embodiment of a coldness generating apparatus according to the present invention.

FIG. 1 is a schematic view which illustrates an absorption type coldness generating apparatus in which heat is regenerated in the form of ice, which is the principle of the present invention. The absorption type coldness generating apparatus comprises an absorption type refrigerator 1, an ice regenerating tank 2, a heat exchanger 3, and a radiator 4. According to the present invention, the absorption type refrigerator 1 comprises an evaporator 10, an absorber 11, a regenerator 12, and a condenser 13. The regenerator 12 is heated by a heat source 20 such as combustion gas or steam. As a result of cooling down the absorber 11 and the condenser 13 with cooling water 21, brine (for example, ethylene glycol) 22 whose temperature is lower than the freezing point can be obtained in the evaporator 10. An absorbent is, for example, LiBr is heated by the regenerator 12 so that refrigerant for example, methanol solution, is evaporated and the absorbent 15 is condensed and transmitted to the absorber 11. The steam of the refrigerant 14 is cooled down by the condenser 13 and is transmitted, in the form of liquid, to the evaporator 10. Since the dense absorbent 15 in the absorber 11 is cooled down, the pressure in the absorber 11 can be lowered. As a result, the refrigerant 14 in the evaporator 10 under the same pressure is evaporated, the temperature of it is lowered below the freezing point so that brine whose temperature is below the freezing point (substantially −6° C.) can be obtained from the evaporator 10.

When coldless is being regenerated, the brine 22 whose temperature is below the freezing point is passed through a three-way valve 33 and is introduced into the regenerating tank 2 so that water in the tank is indirectly cooled down, causing ice to be formed. The brine 22 whose temperature has been raised due to the fact that the regenerating tank 2 had been cooled down is again returned to the evaporator 10 by a circulating pump 31. As a result of the above-described operations, heat energy 20 displaying considerably high temperature is converted into coldness below the freezing point by the absorption type refrigerator 1 so that the heat energy converted into the form of ice is regenerated in the regenerating tank 2.

The radiating (cooling) operation is arranged in such a manner that cold water 35 is, by a cold water pump 32, transmitted from the regenerating tank 2 to the radiator 4 through the three-way valve 34, so that the cooling is conducted. The heated cold water 35 is again returned to the regenerating tank 2 in which it is brought into direct contact with ice so that the temperature of the cold water 35 is lowered. The load (performance) at the time of performing the cooling operation is adjusted by changing the flow of cold water by the cold water pump 32 or the like or by adjusting the degree of opening of the three-way valve 34.

There is a method which is effective in terms of arrangement of a balance between the regenerating performance and the cooling performance, this method being such that the absorption type refrigerator 1 is operated during the cooling operation so as to directly cool down, by the heat exchanger 3, the cold water 35 returned from the radiator 4, in which the brine 22 obtained from the evaporator 10 is used. The thus-cooled down water 35 is again cooled down in the ice regenerator 2. As a result, the operation rate of the absorption type refrigerator 1 can be improved. Furthermore, the cooling operation during day time is shared by both the absorption type refrigerator and the regenerating tank so that the necessary performance for each of the components can be halved. Therefore, the size of the components of the absorption type refrigerator can be reduced.

Figure 2:
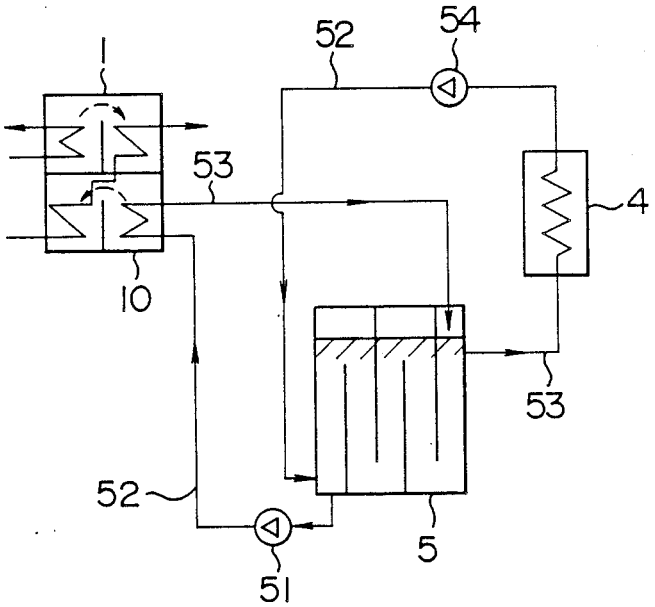
FIG. 2 is a schematic view which illustrates another embodiment of the present invention.

FIG. 2 is a view which illustrates an embodiment in which the absorption type refrigerator and emulsion solution capable of generating ice slurry are combined with each other.

The embodiment of FIG. 2, comprises the absorption type refrigerator, which is the same as that shown in FIG. 1, an ice slurry tank 5, and the radiator 4. In order to regenerate heat, water is replaced by a water/oil type emulsion or a O/W type emulsion. The W/O emulsion is emulsion of the type whose phase-W is solidified by being cooled down, while the O/W emulsion is emulsion of the type whose phase-0 is solidified. For example, when W/0 emulsion solution whose phase-W comprises water and phase-O comprises paracymene which cannot be frozen below the freezing point is used, the W/O emulsion solution is supplied, by a pump 51, from the tank 5 to the evaporator 10 of the absorption type refrigerator 1 in which the same is cooled down below the freezing point so that small spherical water droplets in the phase-W are solidified and become slurry. The thus-obtained slurry is made to be ice slurry liquid 53 displaying excellent fluidity by the phase-0, and the thus-made ice slurry liquid 53 is returned to the tank 5 in which the heat is regenerated. The cooling is so performed by the tank 5 that the ice slurry liquid 53 is sent to the radiator 4 and is utilized for the cooling. W/0 emulsion liquid 52 whose blocks of ice are changed to water droplets due to being heated by the radiator 4 is returned to the tank 5 by the pump 54. Since ice slurry exhibiting excellent fluidity is used according to this embodiment, the brine becomes no longer necessary. As a result, a great efficiency in heat transmission can be obtained since ice slurry displaying high regenerating density can be used to transmit heat.

Figure 3:
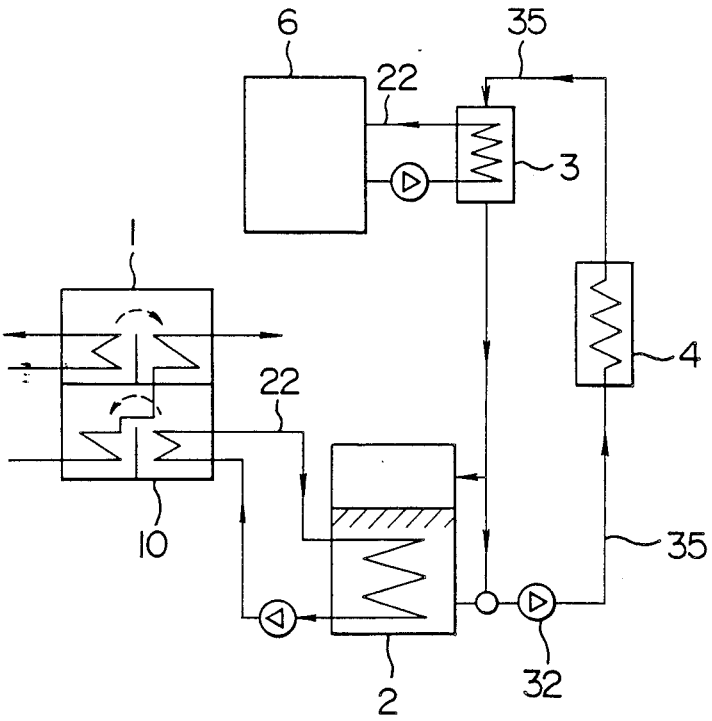
FIGS. 3 to 6 are schematic views which illustrate the other embodiments of the present invention.

In the embodiment of FIG. 3 the compression type heat pump, the absorption type refrigerator, and ice regeneration are combined. Since ice regenerating has been impossible in the conventional absorption type refrigerator, the ice regenerating can be solely conducted by the compression type heat pump. However, if the freezing point is realized by the compression type heat pump, the power consumption becomes excessive. According to the embodiment FIG. 3, the structure is, on the contrary to the conventional structure, arranged in such a manner that ice regeneration is realized by the absorption type refrigerator 1 which is arranged to be operated by an inexpensive heat source such as oil, and cold water (substantially 3° C.) is generated by the compression type heat pump 6. As a result, the electricity consumption can be reduced. The brine 22 whose temperature is lower (substantially −6° C.) than the freezing point is generated by the absorption type refrigerator 1. As a result, ice is generated and regenerated in the regenerating tank 2. The cold water 35, cooled by the heat exchanger 3 with the brine (substantially 3° C.) generated by the compression type heat pump 6 at the time of performing the cooling, is further cooled down by ice or cold water in the ice regenerating tank 2 before being transmitted to the radiator 4. The operation may be conducted such that the absorption type refrigerator and the compression type heat pump are simultaneously operated. When the absorption type refrigerator 1 is operated by variable heat source such as waste heat and solar heat, it is advantageous to employ a method arranged in such a manner that the ice regeneration is conducted by an amount corresponding to the heat source (its quantity and time period) and the shortage of amount in the cooling is compensated by the compression type heat pump. A structure in which ice slurry is employed in the embodiment shown in FIG. 2 can also advantageously employ the last described method.

Figure 4:
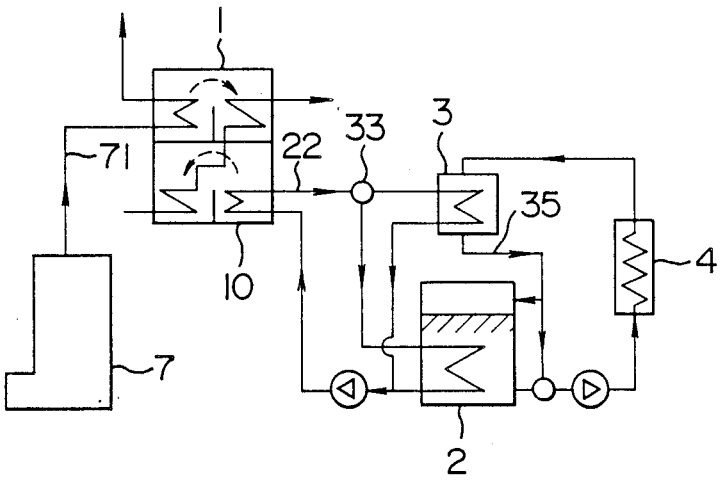

In FIG. 4 waste heat from an industrial boiler or the like is recovered so as to be used for cooling. The absorption type refrigerator 1 is operated by using waste gas 71 from a boiler 7, the waste heat is recovered by the brine 22 whose temperature is below the freezing point, cold water 35 is, via the heat exchanger 3, cooled down, and the thus-cooled down cold water 35 is sent to the radiator 4 for the purpose of being used for cooling. Simultaneously, the excess coldness is sent to the regenerating tank 1 via the three-way valve 33 so as to be regenerated in the form of ice. On the contrary, in a case where the level coldness is insufficient, ice in the regenerating tank 2 is used to supply coldness in addition to the brine in the absorption type refrigerator 1. As a result, insufficient recovery of heat with the conventional structure due to an imbalance between the amount of waste heat and the amount of cooling can be overcome. That is, the excessive amount can be regenerated in the form of ice. As a result, waste heat can be efficiently utilized. According to the embodiment of FIG. 4, the use of ice slurry is advantageous where a distance between the facility in which the industrial boiler is disposed and the subject building or the like to be cooled or heated is considerably long since high density heat transmission can be conducted.

Figure 5:
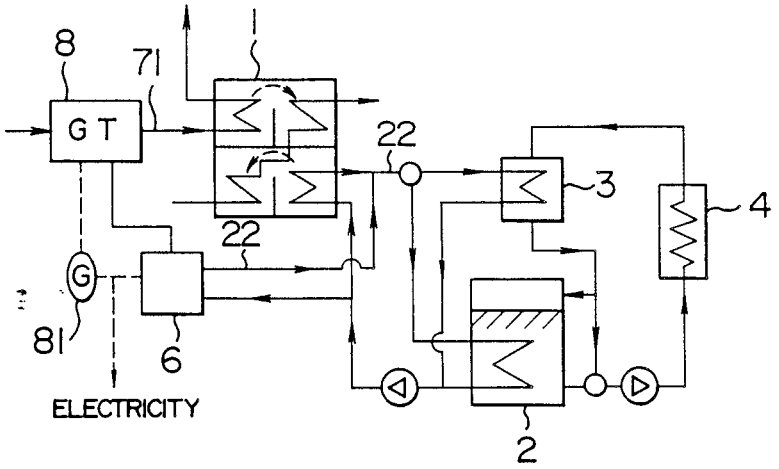

The embodiment of FIG. 5 may be employed in a cogeneration system in which a balance between heat and electricity performs a critical roll. Previously, waste heat from generating facility such as gas turbine, steam turbine or the like is recovered by the absorption type refrigerator and a regenerating method comprises a cold-water regenerating method, causing the size of the regenerating tank to become too large. The facility capacity is arranged to correspond to the demand of heat by a user and no regenerating is conducted. Therefore, the facility capacity is limited and the heat recovery rate can deteriorate in accordance with change in the operating condition. As a result, a problem arises in that the total energy utilization rate is insufficient. To this end, a structure is formed which includes the absorption type refrigerator 1 according to the present invention so that the overall portion of heat recovered from waste heat 71 from the gas turbine 8 is recovered by the absorption type refrigerator 1 in the form of the brine 22 whose temperature is lower than the freezing point. A portion of the thus-recovered heat is used for cooling, the excessive portion is regenerated in the form of ice. The amount of excessive electricity generated by the generator 81 by using the gas turbine 1 is also recovered in the form of the brine 22 whose temperature is lower than the freezing point by the compression type heat pump 6 so that the thus-recovered heat is also regenerated in the form of ice. Therefore, . according to the embodiment FIG. 5, the overall portion of the excess heat and electricity generated due to cogeneration can be regenerated, as the coldness, in the form of ice. As a result, even if the load is varied, electricity and heat can be efficiently recovered, and the total energy utilization rate can be always maintained at a satisfactory level.

Figure 6:
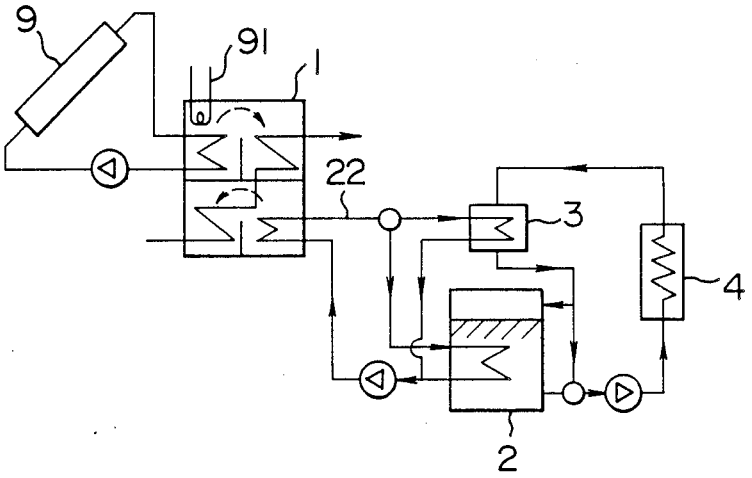

The embodiment of FIG. 6 may be applied to a solar heat cooling/heating system displaying considerable heat source change.

The conventional absorption type refrigerator utilizing solar heat can generate cold water only. Therefore, the imbalance between the amount of solar heat and the demand for the amount of cooling has been regenerated in the portion of the solar heat portion of the apparatus in the form of hot water. However, the thus-utilized hot water displays a considerable amount of heat radiation loss, and when cooling is conducted by utilizing the regenerated heat, a certain initiating time period needs to be taken in order to operate the absorption type refrigerator by using the thus-regenerated heat. As a result, its response is insufficient. Therefore, according to the embodiment FIG. 6, the freezing point generation absorption refrigerator 1 is included in the system above, the overall portion of heat recovered by the heat accumulator 9 is, as the heat source, converted into the brine 22 whose temperature is lower than the freezing point. A portion of the thus-obtained brine 22 is sent to the radiator 4 for cooling. On the other hand, the excessive portion of the thus-obtained brine 22 is sent to the ice regenerator 2 in which it is regenerated in the form of ice. If the cooling performance is insufficient, coldness is supplied from the ice regenerating tank 1. If necessary, a sub-heater 91 for the absorption type refrigerator 1 may be used. As described above, solar heat can be regenerated in the form of ice displaying high regenerating heat density and cold water can directly taken out from the regenerating tank when the cooling is intended to be performed. Therefore, an excellent response can be obtained at the time of performing the cooling.

According to the present invention, since coldness lower than the freezing point can be obtained by the absorption type refrigerator, ice or ice slurry can be readily prepared. Therefore, coldness can be regenerated at high density, causing the cooling performance of the coldness generating apparatus to be improved.

Furthermore, the capacity of the refrigerating tank and/or the diameter of the coldness transmitting pipe can be reduced. Consequently, the size of the facility can be reduced.

What is claimed is:

1. A coldness generating apparatus comprising:

an absorption type refrigerator including an evaporator for evaporating a first refrigerant, an absorber in which an absorbent for absorbing the thus-evaporated refrigerant steam is contained, a regenerator for heating and condensing said absorbent which has been diluted by said refrigerant steam, and a condenser for condensing and liquidizing said refrigerant steam which has been evaporated be heating and condensing said absorbent; and a regenerating tank for regenerating coldness generated by said evaporator through a second refrigerant, wherein said first refrigerant circulating in said absorption type refrigerator to obtain the coldness and said second refrigerant introducing said coldness generated by said evaporator into said regenerating tank and then circulating said coldness in said regenerating tank consists essentially of refrigerant having a solidification temperature lower than the freezing point so that the coldness which is lower than the freezing point and which has been generated in said evaporator is regenerated in the form of ice or ice slurry.

2. A coldness generating apparatus according to claim 1, wherein said refrigerant comprises lower alcohol or mixed solution of lower alcohol and water.

3. A coldness generating apparatus according to claim 1, wherein said refrigerant comprises mixed solution of water and inorganic electrolyte.

4. A coldness generating method comprising the steps of:

arranging an absorption type refrigerator such that an evaporator thereof evaporates a first refrigerant, an absorbent in an absorber absorbs the thus-evaporated refrigerant steam, a regenerator heats and condenses the absorbent diluted by said refrigerant steam, and a condenser liquidizes said refrigerant steam evaporated due to the condensation so that coldness is generated;

providing a regenerating tank for regenerating coldness generated by said evaporator through second refrigerant;

circulating said coldness to the regenerating tank;

regenerating heat by forming ice or ice slurry in said regenerating tank; and circulating said regenerated coldness to a radiator disposed outside a system so that said coldness is radiated, wherein said first refrigerant circulating in said absorption type refrigerator to obtain the coldness and said second refrigerant introducing said coldness generated by said evaporator into said regenerating tank and then circulating said coldness in said regenerating tank consists essentially of refrigerant having a solidification temperature lower than the freezing point so that the coldness which is lower than the freezing point and which has been generated in said evaporator enables the regeneration in the form of the ice or ice slurry.

5. A coldness generating method according to claim 4, wherein said slurry is circulated to said radiator as to enable the radiation of the coldness.

6. A coldness generating method according to claim 4, wherein ice slurry made of a water/oil type emulsion is prepared in said regenerating tank, and said slurry is circulated to said radiator so as to enable the radiation of the coldness.

7. A coldness generating method according to claim 4, wherein coldness generated by a compression type heat pump is also used.

8. A coldness generating apparatus comprising:

an absorption type refrigerator including an evaporator for evaporating a first refrigerant, an absorber in which an absorbent for absorbing the thus-evaporated refrigerant steam is contained, a regenerator for heating and condensing said absorbent which has been diluted by said refrigerant steam, and a condenser for condensing and liquidizing said refrigerant steam which has been evaporated by heating and condensing said absorbent;

a regenerating tank for regenerating coldness generated by said evaporator through a second refrigerant; and a radiator; and wherein said first refrigerant circulating in said absorption type refrigerator to obtain the coldness and said second refrigerant introducing said coldness generated by said evaporator into said regenerating tank and then circulating said coldness in said regenerating tank consists essentially of refrigerant having a solidification temperature lower than the freezing point so that the coldness which is lower than the freezing point and which has been generated in said evaporator is regenerated in the form of ice or ice slurry, and wherein a heat exchanger is arranged in a passage of cold water returned from said radiator to said regenerating tank so as to enable the heat exchanger to cool down the returned cold water.

9. A coldness generating apparatus according to claim 8, wherein said heat exchanger cools down the returned cold water through said second refrigerant.

10. A coldness generating apparatus according to claim 8, wherein said heat exchanger cools down the returned cold water with a compression type heat pump.

* * * * *